US011098711B2

(12) United States Patent
Matsumoto et al.

(10) Patent No.: US 11,098,711 B2
(45) Date of Patent: Aug. 24, 2021

(54) PUMP DEVICE

(71) Applicant: IWAKI CO., LTD., Tokyo (JP)

(72) Inventors: Yuichi Matsumoto, Sayama (JP); Toshiaki Hada, Sayama (JP)

(73) Assignee: IWAKI CO., LTD., Tokyo (JP)

( * ) Notice: Subject to any disclaimer, the term of this patent is extended or adjusted under 35 U.S.C. 154(b) by 90 days.

(21) Appl. No.: 16/322,761

(22) PCT Filed: Sep. 28, 2016

(86) PCT No.: PCT/JP2016/078635
§ 371 (c)(1),
(2) Date: Feb. 1, 2019

(87) PCT Pub. No.: WO2018/061110
PCT Pub. Date: Apr. 5, 2018

(65) Prior Publication Data
US 2019/0203706 A1 Jul. 4, 2019

(51) Int. Cl.
*F04B 53/16* (2006.01)
*F04D 29/40* (2006.01)
*F04B 53/22* (2006.01)
*F04B 43/04* (2006.01)

(52) U.S. Cl.
CPC ..... *F04B 53/16* (2013.01); *F04B 43/04* (2013.01); *F04B 53/22* (2013.01); *F04D 29/40* (2013.01)

(58) Field of Classification Search
CPC ..... F04B 53/16; F04B 53/22; F04B 43/02; F04B 43/04; F04B 49/00; F04B 17/03; F04B 45/04; F04B 45/047; F04D 29/00; F04D 29/40; Y10T 403/32319;
(Continued)

(56) References Cited

U.S. PATENT DOCUMENTS 4,918,930 A * 4/1990 Gaudet ..... F04B 37/08 417/901
5,667,179 A * 9/1997 Rosen ..... F16C 11/10 248/278.1
5,801,465 A * 9/1998 Yamada ..... H01R 13/523 174/77 R

FOREIGN PATENT DOCUMENTS

EP 2 354 553 A1 8/2011
JP H03-071183 U 7/1991
JP H05-057371 U 7/1993
(Continued)

OTHER PUBLICATIONS

Aug. 8, 2019 Extended Search Report issued in European Patent Application No. 16917663.3.
(Continued)

*Primary Examiner* — Devon C Kramer
*Assistant Examiner* — David N Brandt
(74) *Attorney, Agent, or Firm* — Oliff PLC

(57) ABSTRACT

The pump device includes: a pump body which transfers a transfer fluid; a drive unit which drives the pump body; an operating unit which sets an operation of the drive unit; and a joint mechanism which attaches the operating unit to the drive unit. The drive unit includes a casing. The operating unit includes a user-accessible operating surface. The joint mechanism is attached to a wall surface of the casing so as to be rotationally operable about a first axis perpendicular to the wall surface and supports the operating unit such that the operating surface crosses a second axis perpendicular to the first axis and follows along an outer surface of the casing.

18 Claims, 7 Drawing Sheets

(58) Field of Classification Search
CPC ..... Y10T 403/32327; Y10T 403/32326; Y10T 403/32368
See application file for complete search history.

(56) References Cited

FOREIGN PATENT DOCUMENTS

| | | | |
|---|---|---|---|
| JP | 3015115 | U | 8/1995 |
| JP | 2013-517423 | A | 5/2013 |
| WO | 90/02878 | A2 | 3/1990 |
| WO | 2011/088976 | A1 | 7/2011 |
| WO | 2011/106530 | A1 | 9/2011 |

OTHER PUBLICATIONS

Dec. 27, 2016 International Search Report issued in International Patent Application No. PCT/JP2016/078635.

* cited by examiner

A-A' CROSS SECTION

B-B' CROSS SECTION

PUMP DEVICE

TECHNICAL FIELD

The present invention relates to a pump device which transfers a transfer fluid.

BACKGROUND ART

As a pump device which transfers a transfer fluid, there have been known a variety of devices such as a magnetic pump device, a metering pump device, and a rotary displacement pump device. These pump devices essentially consist of two parts. Specifically, the pump device has a two-part structure comprising a drive unit housing such as a drive motor and a pump body connected to the drive unit housing.

A recent pump device further comprises a controller (control device) attached to the drive unit housing to control the drive motor. The controller includes an operating unit having, for example, a user-accessible operating surface, and is disposed in a state of being electrically connected to the drive motor.

There has been known a pump device which, for example, includes such an operating unit outside the drive unit housing and can change the direction of the operating surface according to the installation location and installation position of the pump device (for example, see Patent Literature 1). Specifically, this pump device is configured such that the operating device can be disposed on two different sidewalls of a polyhedral motor housing.

CITATION LIST

Patent Literature

[Patent Literature 1]Japanese Patent No. 5778693

SUMMARY OF INVENTION

Technical Problem

However, the pump device of the related art disclosed in Patent Literature 1 requires a complicated procedure such that when the operating device is to be installed in the motor housing, the operating device is disassembled and temporarily removed from the motor housing, its position is changed, and then it is attached and fixed to the motor housing again. Therefore, the above procedure not only involves a complicated operation of changing the position of the operating device, but also, depending on the installation location, this position change operation needs to be finished before the pump device is installed, which restricts the installation procedure of the pump device.

In order to solve the above described problems of the related art, the present invention has been made with an object of providing a pump device capable of improving the degree of freedom in installation of the pump device by eliminating the need to disassemble and remove the operating unit and allowing the position of the operating unit and the direction of the operating surface to be freely set.

Solution to Problem

A pump device according to the present invention comprises: a pump body transferring a transfer fluid; a drive unit driving the pump body; an operating unit setting an operation of the drive unit; and a joint mechanism attaching the operating unit to the drive unit, wherein the drive unit includes a casing; the operating unit includes a user-accessible operating surface; and the joint mechanism is attached to a wall surface of the casing so as to be rotationally operable about a first axis perpendicular to the wall surface and supports the operating unit such that the operating surface crosses a second axis perpendicular to the first axis and follows along an outer surface of the casing.

In an embodiment of the present invention, the joint mechanism supports the operating unit so as to be rotationally operable about the second axis.

In another embodiment of the present invention, each of the pump body, the drive unit, and the operating unit has a waterproof structure; and the drive unit is connected to the operating unit inside the joint mechanism via a waterproof connector.

In still another embodiment of the present invention, the joint mechanism and the casing includes a first intermittent rotation mechanism at a joint portion between the joint mechanism and the casing, the first intermittent rotation mechanism positioning the joint mechanism at a plurality of angles in a rotational direction about the first axis relative to the casing.

In still another embodiment of the present invention, the joint mechanism and the operating unit includes a second intermittent rotation mechanism at a joint portion between the joint mechanism and the operating unit, the second intermittent rotation mechanism positioning the operating unit at a plurality of angles in the rotational direction about the second axis relative to the joint mechanism.

In still another embodiment of the present invention, the joint mechanism can position the operating unit at a plurality of positions about the first axis within a range extending from one side surface side of the casing to the other side surface side through an upper surface side. The joint mechanism can also position the operating unit in four directions at intervals of 90° in the rotational direction about the second axis in each of the plurality of positions about the first axis.

In still another embodiment of the present invention, the operating unit includes a display means displaying information on the pump device on the operating surface; and an operation means receiving an operation input to the pump device from the operating surface.

Advantageous Effects of Invention

The present invention can eliminate the need to disassemble and remove the operating unit, can freely set the position of the operating unit and the direction of the operating surface, and thereby can improve the degree of freedom in installation of the pump device.

DESCRIPTION OF EMBODIMENTS

Hereinafter, a pump device according to an embodiment of the present invention will be described in detail with reference to the accompanying drawings. It should be noted that the following embodiment does not limit the invention according to each claim, and all the combinations of features described in the embodiment are not always essential for solving means of the present invention.

Figure 1:
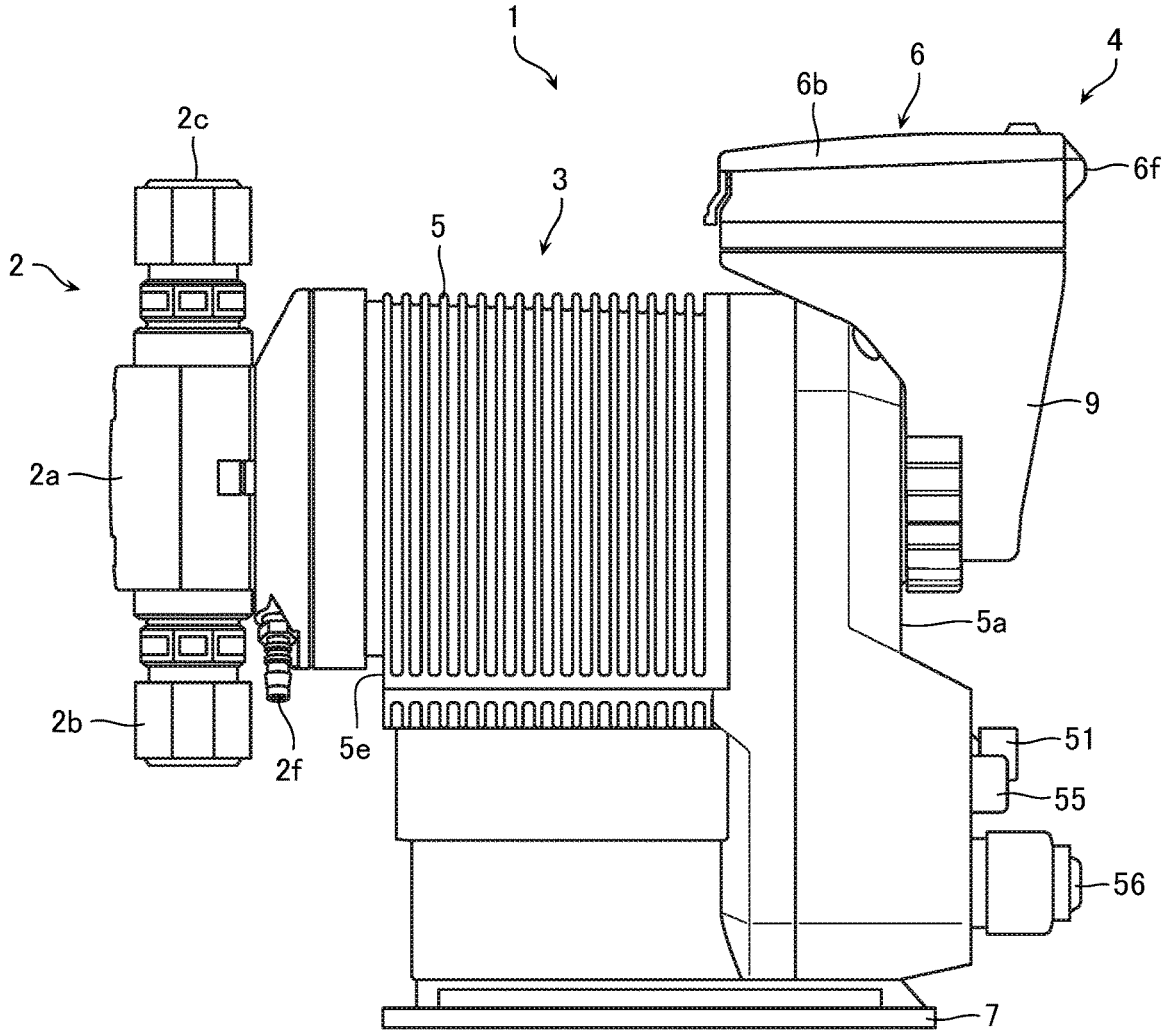
FIG. 1 is a side view illustrating an outer appearance of a pump device according to an embodiment of the present invention.
Figure 2:
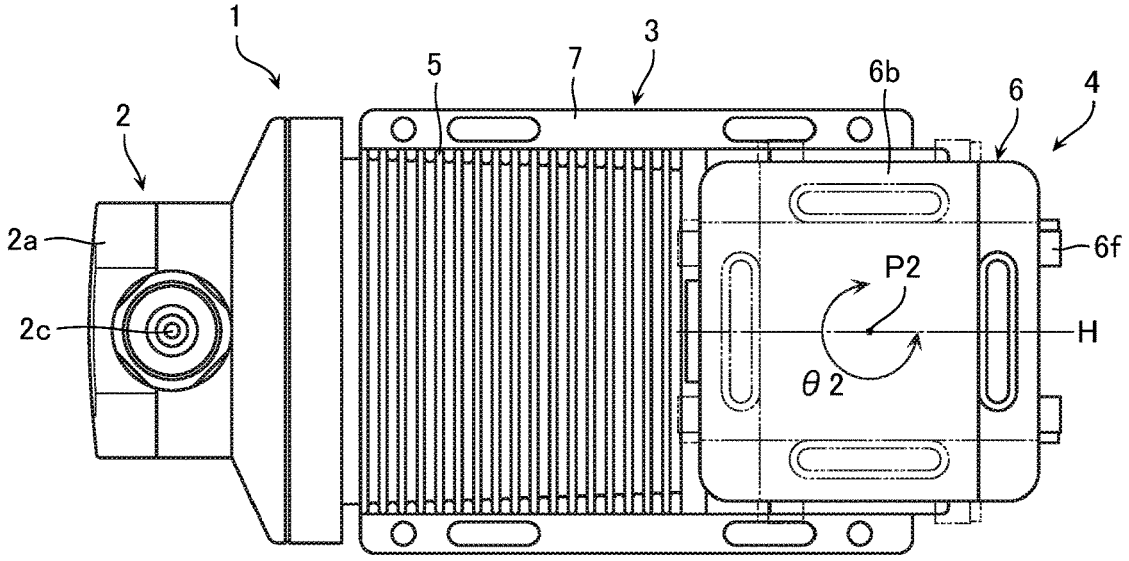
FIG. 2 is a plan view illustrating the outer appearance of the pump device.
Figure 3:
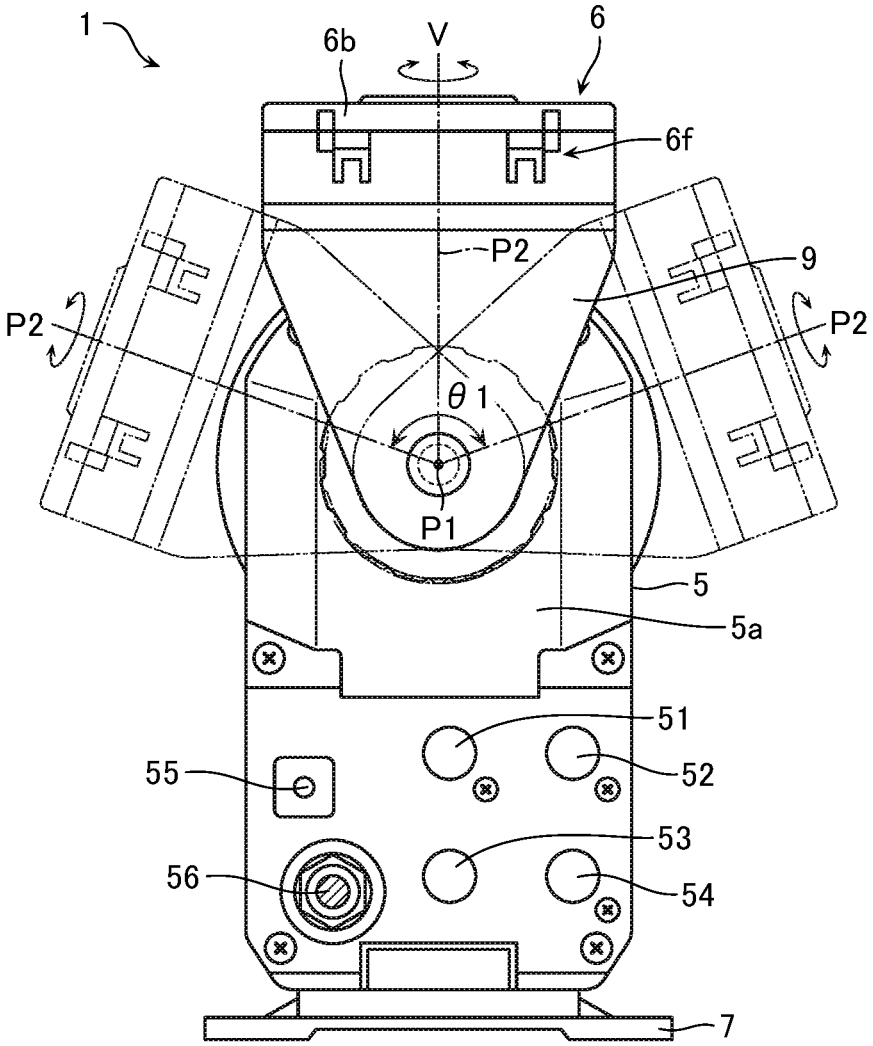
FIG. 3 is a rear view illustrating the outer appearance of the pump device.

FIGS. 1, 2, and 3 are a side view, a plan view, and a rear view respectively, each illustrating an outer appearance of a pump device 1 according to an embodiment of the present invention.

As illustrated in FIGS. 1 to 3, the pump device 1 according to an embodiment of the present invention is configured to comprise a pump body 2 which transfers a transfer fluid, for example, by a direct-acting diaphragm quantitative pump device or the like; a drive unit 3 which drives this pump body 2; and a controller 4 which controls this drive unit 3.

The pump body 2 is configured to comprise a pump head 2*a* having an unillustrated diaphragm and pump chamber inside thereof; a suction port 2*b* of a transfer fluid; and a discharge port 2*c* thereof, each port being connected to the pump chamber. This pump body 2 further includes a drain port 2*f* for discharging a transfer fluid from inside the pump chamber, for example, when the diaphragm is broken.

The drive unit 3 includes a casing 5 which incorporates a drive motor for driving the pump body 2; a reciprocating transmission mechanism; a control circuit for controlling these units; a power supply circuit for supplying a power supply voltage to these units, and the like. The casing 5 is a generally substantially rectangular polyhedron and both side surfaces of the upper surface have a slightly cylindrically chamfered shape. The casing 5 is configured such that the pump body 2 is connected to a front surface 5*e*; the controller 4 is connected to a rear surface 5*a*; and a base plate 7 for fixing the pump device 1 is connected to a lower surface.

The controller 4 includes an operating unit 6 for setting an operation of the pump device 1; and a joint mechanism 9 for attaching this operating unit 6 to the rear surface 5*a* (an example of a wall surface) of the casing 5.

Figure 4:
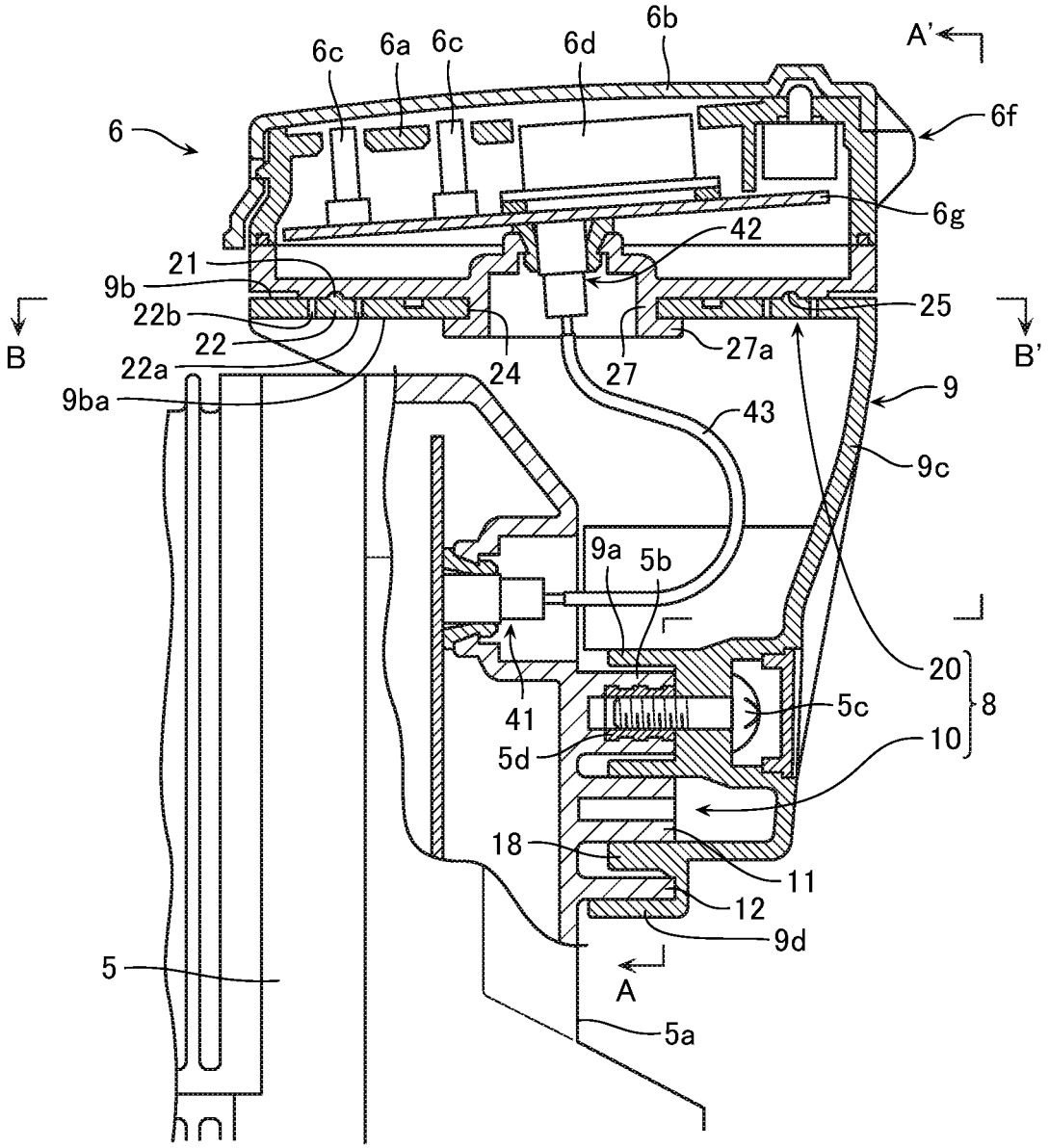
FIG. 4 is a longitudinal sectional view illustrating an internal structure of a controller of the pump device.
Figure 5:
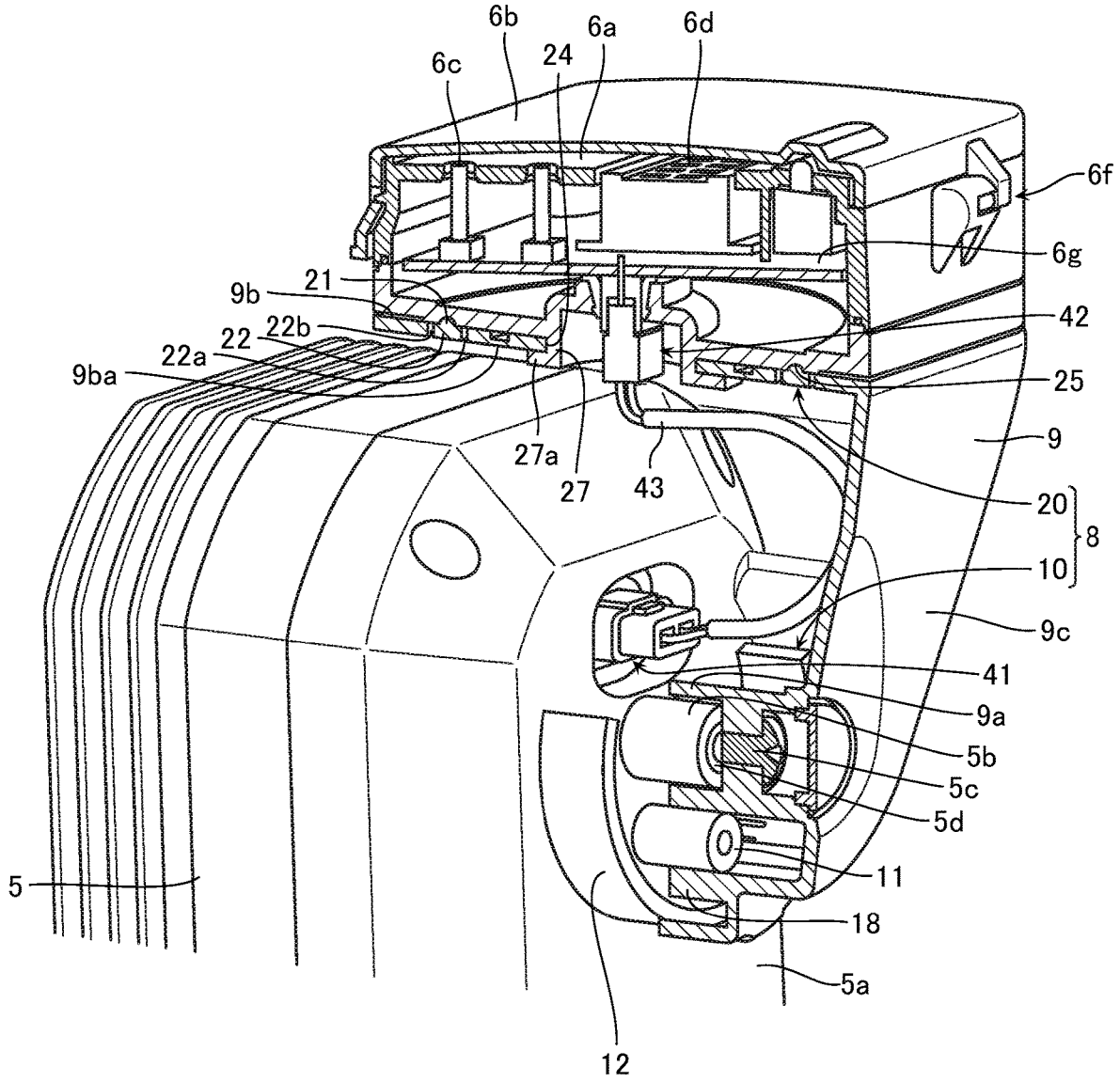
FIG. 5 is a perspective sectional view illustrating the internal structure of the controller of the pump device.
Figure 6:
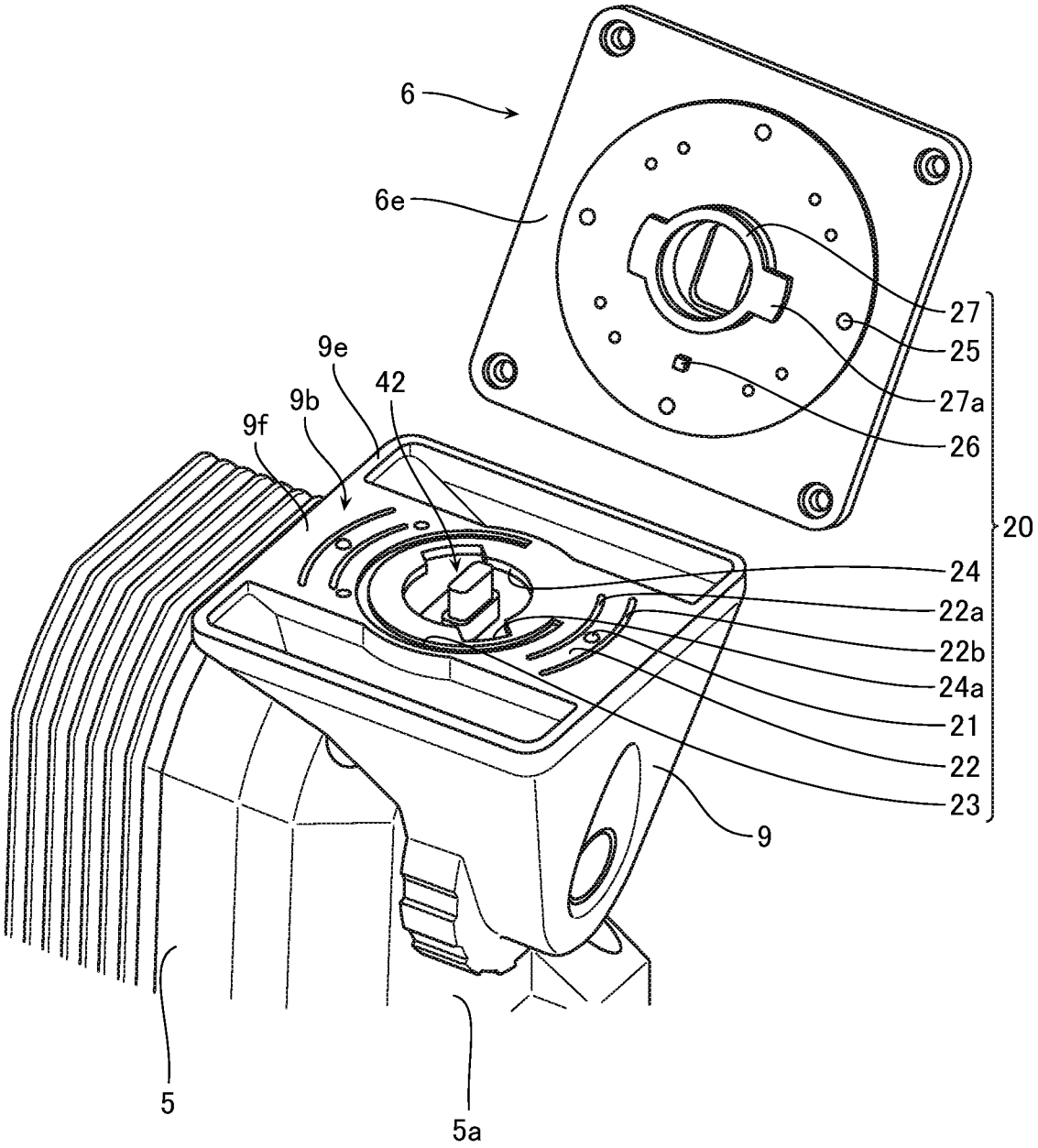
FIG. 6 is a perspective view illustrating a state in which the operating unit is removed from the pump device.
Figure 7:
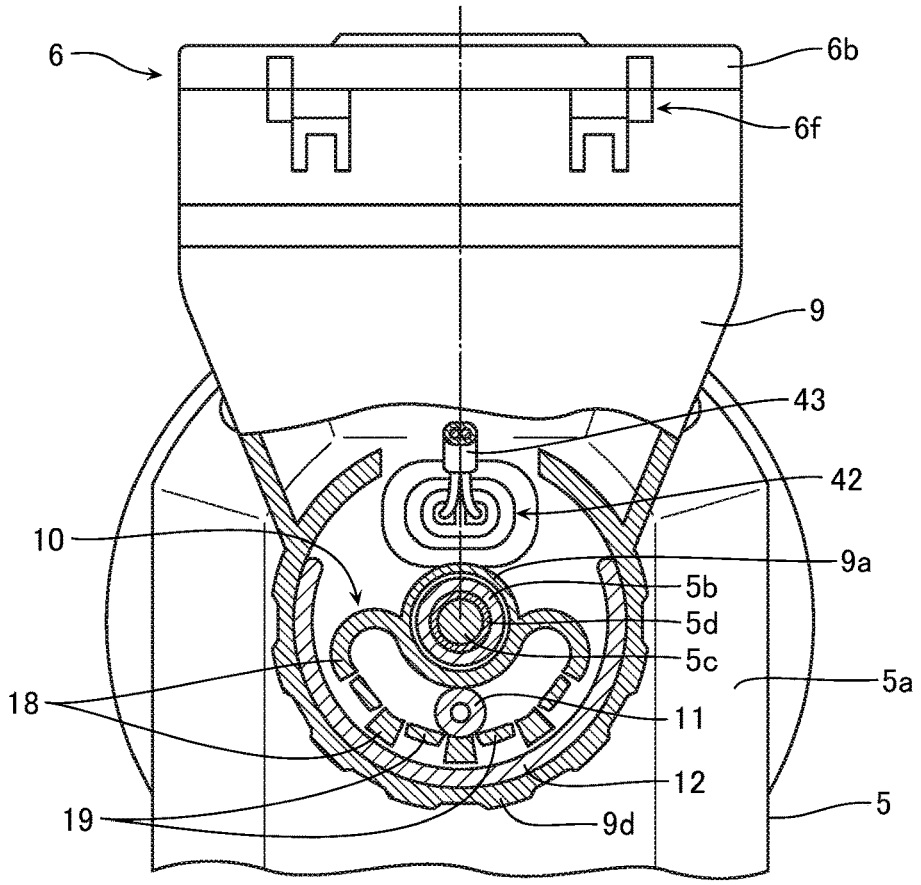
FIG. 7 is a sectional view taken along line A-A' of FIG. 4.
Figure 8:
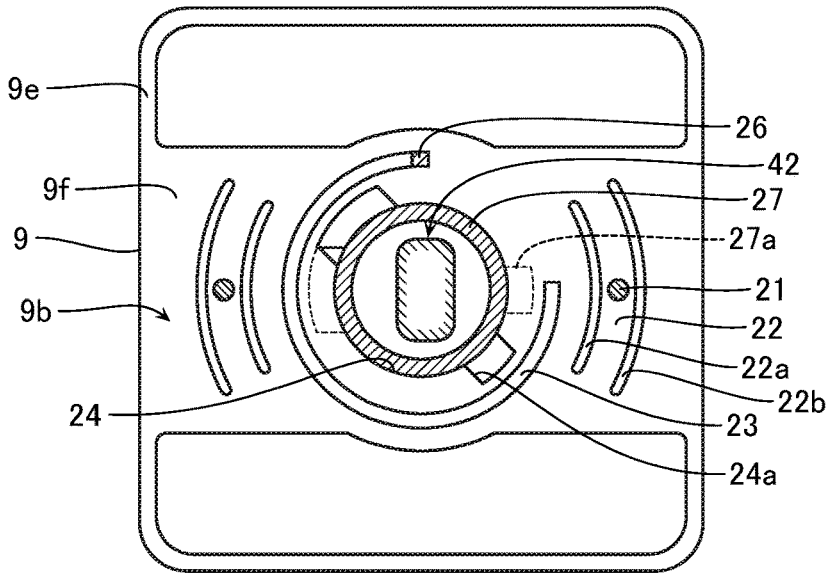
FIG. 8 is a sectional view taken along line B-B' of FIG. 4.

FIGS. 4 and 5 each illustrate a cross section of the internal structure of the controller 4.

The operating unit 6 has a user-accessible operating surface 6*a*. This operating surface 6*a* includes an LCD 6*d* serving as a display means for displaying information on the pump device 1; and a push-button 6*c* serving as an operation means for receiving an operation input to the pump device 1. A lid portion 6*b* is attached to above the operating surface 6*a* of the operating unit 6 via a hinge portion 6*f* in a freely openable and closable manner. The operating unit 6 further includes an internal substrate 6*g* constituting an internal circuit having thereon electronic components such as the LCD 6*d* and the push-button 6*c*. Note that the internal substrate 6*g* may include thereon a part of the above described control circuit. This internal substrate 6*g* is electrically connected to the control circuit inside the casing 5 by a connection cable 43 whose both end portions have waterproof connectors 41 and 42 attached thereto. Note that both the operating unit 6 and the casing 5 have a waterproof structure.

In order to install the operating unit 6, the joint mechanism 9 includes a rectangular upper surface portion 9*b*; and a downwardly-oriented triangular rotary joint portion 9*c* extending downward from a portion on a rear side of the upper surface portion 9*b*. A lower end portion of the rotary joint portion 9*c* is attached to the rear surface 5*a* of the casing 5 so as to be rotationally operable about a first axis P1 (horizontal axis in this example) perpendicular to the rear surface 5*a*.

The operating unit 6 is connected to the upper surface portion 9*b* of the joint mechanism 9 so that the operating surface 6*a* can be seen from a direction of a second axis P2 perpendicular to the first axis P1, namely, a direction toward the upper surface portion 9*b*. The operating unit 6 is positioned at any position along an outer surface of the casing 5 within an angular range θ1 from one side surface side (a first surface side) of the casing 5 to the other side surface side (a second surface side) via the upper surface side according to the rotary operation of the joint mechanism 9. As illustrated in FIG. 3, the operating unit 6 is connected to the joint mechanism 9 so as to be rotationally operable about the second axis P2.

Note that a lower portion of the rear surface 5*a* of the casing 5 includes an EXT operation terminal 51, a STOP terminal 52, an AUX terminal 53, a communication terminal 54 and an output terminal 55 which can be connected to, for example, an external electronic device which can monitor and control the pump device 1. Note also that a power cord 56 is connected to a lower portion of the output terminal 55.

Then, the description will focus on a specific configuration for setting the position and the angle of the operating unit 6 with reference to FIGS. 4 to 9.

In order to rotate the operating unit 6 about each of the first axis P1 and the second axis P2 relative to the casing 5, this embodiment provides a multi-axis rotation connection mechanism 8 between the joint mechanism 9, the casing 5, and the operating unit 6. For example, the multi-axis rotation connection mechanism 8 includes a first intermittent rotation mechanism 10 interposed between the joint mechanism 9 and the casing 5; and a second intermittent rotation mechanism 20 interposed between the joint mechanism 9 and the operating unit 6. As illustrated in FIG. 3, in the present embodiment, this multi-axis rotation connection mechanism 8 is configured such that by the first intermittent rotation mechanism 10, the operating surface 6*a* of the operating unit 6 can be positioned, for example, in five directions at intervals of 35° to 45° within an inclination range θ1 of ±70° to ±90° about the first axis P1 relative to the vertical direction (perpendicular direction). More specifically, by the first intermittent rotation mechanism 10, the operating surface 6*a* can be positioned in each direction of a direction of +70° to +90°, a direction of +35° to +45°, a direction of 0°, a direction of −35° to −45°, and a direction of −70° to −90° about the first axis P1 relative to the vertical line V.

Further, as illustrated in FIG. 2, in the multi-axis rotation connection mechanism 8, by the second intermittent rotation mechanism 20, the operating surface 6*a* of the operating unit 6 can be positioned, for example, in four directions at intervals of 90° within a rotation range θ2 of 270° about the second axis P2. More specifically, by the second intermittent rotation mechanism 20, the operating surface 6*a* can be positioned in each direction of a direction of 0°, a direction of 90°, a direction of 180°, and a direction of 270° about the second axis P2 relative to the horizontal line H.

The first intermittent rotation mechanism 10 is configured as follows. Specifically, as illustrated in FIGS. 4, 5, 7, and 9, a cylindrical shaft pin 5*b* (a connection point) protrudes from the rear surface 5*a* of the casing 5. A cylindrical fitting wall 9*a* is protrudingly provided from inside the rotary joint portion 9*c* of the joint mechanism 9. This fitting wall 9*a* is rotatably fitted to the shaft pin 5*b* about the shaft pin 5*b*. A cylindrical angle determination boss 11 is protrudingly provided at a position away from the shaft pin 5*b* of the rear surface 5*a* of the casing 5. Meanwhile, inside the rotary joint portion 9*c* of the joint mechanism 9, a plurality of plate-like elastic pieces 19 and boss support portions 18 are alternately positioned along a circular arc inscribed to the angle determination boss 11 about the shaft pin 5*b*. In order to regulate the movement in the rotational direction of the angle determination boss 11, the boss support portions 18 at both ends are formed in a semicircular arc shape to be fitted to the angle determination boss 11 and are integrally formed with the fitting wall 9*a*. Note that the rear surface 5*a* of the casing 5 includes a semicircular guide rail 12 which houses the shaft pin 5*b*, the fitting wall 9*a*, the angle determination boss 11, the boss support portions 18, and the elastic pieces 19. Meanwhile, a guide ring 9*d* in sliding contact with an outer peripheral surface of the guide rail 12 is provided on a side of the joint mechanism 9.

Figure 9:
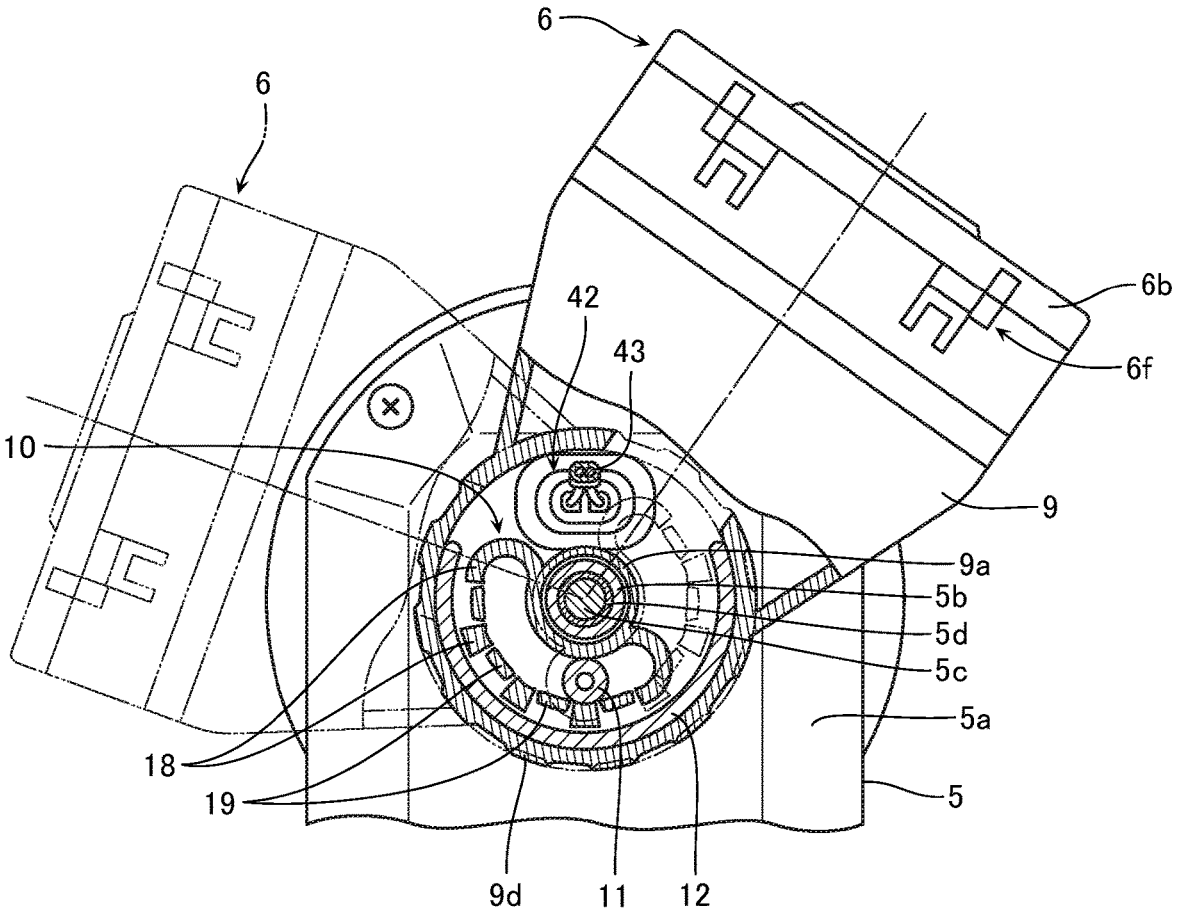
FIG. 9 is a partial sectional view illustrating a movement of the operating unit of the pump device.

According to thus configured first intermittent rotation mechanism 10, as illustrated in FIG. 9, the joint mechanism 9 rotates about the shaft pin 5*b* protruding from the rear surface 5*a* of the casing 5, and at five positions where the angle determination boss 11 is in contact with the boss support portions 18, the angle determination boss 11 is released from an elastic restoring force from the elastic pieces 19 to generate a predetermined operational feeling (click feeling). The user can easily select any one of the five positions and can fixedly connect the joint mechanism 9 to the casing 5 by screwing the mounting screw 5*c* to the bush 5*d* attached to a center hole of the shaft pin 5*b* at the selected position.

Meanwhile, the second intermittent rotation mechanism 20 is configured as follows. Specifically, as illustrated in FIGS. 4, 5, 6, and 8, the upper surface portion 9*b* of the joint mechanism 9 includes a substantially square outer frame portion 9*e*; and a strip-shaped portion 9*f* connecting a central portion of the two opposing sides of the outer frame portion 9*e*, wherein an annular hole 24 is formed in a central portion of the strip-shaped portion 9*f*. A pair of large and small notches 24*a* are formed at two places facing in a diagonal direction of the outer frame portion 9*e* in a peripheral portion of the annular hole 24 of the upper surface portion 9*b*. Further, the upper surface portion 9*b* includes, outside the annular hole 24, a ¾ arc-shaped guide groove 23, arc-shaped slits 22*a* and 22*b* concentric with the annular hole 24, which are formed in order from the inside. A spring piece 22 is formed between the slits 22*a* and 22*b* of the upper surface portion 9*b*. A convex portion 21 is formed in an upper central portion of this spring piece 22 protruding toward the side of the operating unit 6.

Meanwhile, an annular collar 27 fitted into the annular hole 24 is protrudingly provided in a central portion of a back surface 6*e* of the operating unit 6. A pair of large and small hooking pieces 27*a* corresponding to the notches 24*a* are formed at two places facing in a radial direction of the annular collar 27. Further, the back surface 6*e* of the operating unit 6 includes a guide protruding portion 26 fitted into the guide groove 23; and a concave portion 25 engaged with the convex portion 21.

According to thus configured second intermittent rotation mechanism 20, the annular collar 27 of the back surface 6*e* of the operating unit 6 is fitted into the annular hole 24 of the upper surface portion 9*b* of the joint mechanism 9, the hooking piece 27*a* is fitted into the notch 24*a*, and the guide protruding portion 26 is inserted so as to be engaged with the guide groove 23, whereby the operating unit 6 can be attached to the joint mechanism 9. Specifically, the operating unit 6 is attached to the joint mechanism 9 by inserting the annular collar 27 into the annular hole 24 so as to hook the hooking piece 27*a* to a back surface 9*ba* of the upper surface portion 9*b* through the notch 24*a* and rotating it about the second axis P2.

When the convex portion 21 is engaged with the concave portion 25, the operating unit 6 is positioned at each position within a rotation range θ2 by the second intermittent rotation mechanism 20, whereby the direction of the operating surface 6*a* is fixed. When each direction of the operating surface 6*a* is determined, the operating unit 6 stops the rotation with an operational feeling due to the elastic restoring force of the spring piece 22. Since the operating unit 6 regulates the rotation in a state in which the guide protruding portion 26 is fitted into the guide groove 23, the connection cable 43 is prevented from rotating in a range equal to or greater than the rotation range θ2 and being twisted.

As described above, the pump device 1 according to the present embodiment is configured such that the operating unit 6 having the operating surface 6*a* is attached to the casing 5 via the joint mechanism 9 having the multi-axis rotation connection mechanism 8. Therefore, the direction of the operating surface 6*a* of the operating unit 6 can be positioned in a total of 20 directions: five directions about the first axis P1 and four directions about the second axis P2. As described above, the present invention can eliminate the need to disassemble and remove the operating unit 6, can freely set the position of the operating unit 6 and the direction of the operating surface 6*a*, and thereby can improve the degree of freedom in installation of the pump device 1.

Hereinbefore, the embodiment of the present invention has been described, but this embodiment has been presented as an example and is not intended to limit the scope of the invention. This novel embodiment can be implemented in various other forms, and various omissions, replacements, and modifications can be made without departing from the gist of the invention. This embodiment and its modifications are included in the scope and gist of the invention and are also included in the invention described in the claims and the equivalent scope thereof.

For example, the above embodiment has been described such that the operating unit 6 is attached to the rear surface 5*a* of the casing 5 via the joint mechanism 9, but various forms may be adopted such as an operating unit being attached to a side surface of the casing 5 as long as the operating unit can be positioned in each direction of a plurality of directions about the first axis P1 and a plurality of directions about the second axis P2. In addition, the joint mechanism 9 and the multi-axis rotation connection mechanism 8 are not limited to the above described respective shapes and structures as long as the mechanism can change the position of the operating unit 6 and the direction of the operating surface 6*a*.

REFERENCE SIGNS LIST

1 pump device
2 pump body

3 drive unit
4 controller
5 casing
5*a* rear surface
6 operating unit
6*a* operating surface
6*e* back surface
8 multi-axis rotation connection mechanism
9 joint mechanism
9*a* fitting wall
10 first intermittent rotation mechanism
11 angle determination boss
12 guide rail
18 boss support portion
19 elastic piece
20 second intermittent rotation mechanism
21 convex portion
22 spring piece
23 guide groove
24 annular hole
24*a* notch
25 concave portion
26 guide protruding portion
27 annular collar
27*a* hooking piece

The invention claimed is:

1. A pump device comprising:
a pump body transferring a transfer fluid;
a drive unit driving the pump body;
an operating unit setting an operation of the drive unit; and
a joint mechanism attaching the operating unit to the drive unit, wherein:
the drive unit includes a casing, and the casing has a front surface and a rear surface opposite to the front surface,
the pump body is connected to the front surface of the casing;
the operating unit includes a user-accessible operating surface;
the joint mechanism has an upper surface portion and a rotary joint portion extending from the upper surface portion, the upper surface portion is installed on the operating unit, the rotary joint portion is attached to the rear surface of the casing at a connection point, the joint mechanism being rotationally operable about a first axis that is perpendicular to the rear surface at the connection point, the joint mechanism being configured to support a movement of the operating unit such that the operating surface crosses a second axis perpendicular to the first axis and sweeps along an outer surface of the casing to position the operating unit at a plurality of positions about the first axis within a range extending from a first surface side of the casing to a second surface side over an upper surface side of the casing.

2. The pump device according to claim 1, wherein
the joint mechanism supports the operating unit such that the operating unit is rotationally operable about the second axis.

3. The pump device according to claim 1, wherein:
each of the pump body, the drive unit, and the operating unit has a waterproof structure; and
a waterproof connector electrically connects the drive unit to the operating unit, and the waterproof connector is disposed within the joint mechanism.

4. The pump device according to claim 1, wherein
a first intermittent rotation mechanism, including a shaft pin and a boss portion, is provided at a joint portion between the joint mechanism and the casing, the first intermittent rotation mechanism positioning the joint mechanism at a plurality of angles in a rotational direction about the first axis relative to the casing.

5. The pump device according to claim 1, wherein
a second intermittent rotation mechanism, including a strip-shaped portion, is provided at a joint portion between the joint mechanism and the operating unit, the second intermittent rotation mechanism positioning the operating unit at a plurality of angles in a rotational direction about the second axis relative to the joint mechanism.

6. The pump device according to claim 2, wherein
the joint mechanism is configured to:
position the operating unit in four positions at intervals of 90° about the second axis in each of the plurality of positions about the first axis.

7. The pump device according to claim 1, wherein:
the operating unit includes a display that is configured to display information on the pump device on the operating surface; and
a push-button that is configured to send an operation input to the pump device from the operating surface.

8. The pump device according to claim 2, wherein:
each of the pump body, the drive unit, and the operating unit has a waterproof structure; and
a waterproof connector electrically connects the drive unit to the operating unit, and the waterproof connector is disposed within the joint mechanism.

9. The pump device according to claim 2, wherein
a first intermittent rotation mechanism, including a shaft pin and a boss portion, is provided at a joint portion between the joint mechanism and the casing, the first intermittent rotation mechanism positioning the joint mechanism at a plurality of angles in a rotational direction about the first axis relative to the casing.

10. The pump device according to claim 2, wherein
a second intermittent rotation mechanism, including a strip-shaped portion, is provided at a joint portion between the joint mechanism and the operating unit, the second intermittent rotation mechanism positioning the operating unit at a plurality of angles in a rotational direction about the second axis relative to the joint mechanism.

11. The pump device according to claim 2, wherein
the operating unit includes a display that is configured to display information on the pump device on the operating surface; and
a push-button that is configured to send an operation input to the pump device from the operating surface.

12. The pump device according to claim 3, wherein
a first intermittent rotation mechanism, including a shaft pin and a boss portion, is provided at a joint portion between the joint mechanism and the casing, the first intermittent rotation mechanism positioning the joint mechanism at a plurality of angles in a rotational direction about the first axis relative to the casing.

13. The pump device according to claim 3, wherein
a second intermittent rotation mechanism, including a strip-shaped portion, is provided at a joint portion between the joint mechanism and the operating unit, the second intermittent rotation mechanism positioning the operating unit at a plurality of angles in a rotational direction about the second axis relative to the joint mechanism.

14. The pump device according to claim 3, wherein:

the operating unit includes a display that is configured to display information on the pump device on the operating surface; and a push-button that is configured to send an operation input to the pump device from the operating surface.

15. The pump device according to claim 4, wherein:

a second intermittent rotation mechanism, including a strip-shaped portion, is provided at a joint portion between the joint mechanism and the operating unit, the second intermittent rotation mechanism positioning the operating unit at a plurality of angles in a rotational direction about the second axis relative to the joint mechanism.

16. The pump device according to claim 4, wherein the operating unit includes a display that is configured to display information on the pump device on the operating surface; and a push-button that is configured to send an operation input to the pump device from the operating surface.

17. The pump device according to claim 5, wherein the operating unit includes a display that is configured to display information on the pump device on the operating surface; and a push-button that is configured to receive an operation input to the pump device from the operating surface.

18. The pump device according to claim 5, wherein the second intermittent rotation mechanism includes an annular collar, an annular hole, a convex portion and a concave portion.

* * * * *